US005109926A

United States Patent [19]

Mody et al.

[11] Patent Number: 5,109,926

[45] Date of Patent: May 5, 1992

[54] WELLBORE PACKER WITH SHEARABLE ANTI-ROTATION LOCKING MEMBER

[75] Inventors: Rustom K. Mody; Vel Berzin, both of Houston; Randle E. Ford, Kingwood; James C. Burtner, III, Spring, all of Tex.

[73] Assignee: Baker Hughes Incorporated, Houston, Tex.

[21] Appl. No.: 612,604

[22] Filed: Nov. 12, 1990

[51] Int. Cl.[5] ..... E21B 33/127

[52] U.S. Cl. ..... 166/187; 277/34.6

[58] Field of Search ..... 166/387, 120, 187; 277/34, 34.6

[56] References Cited

U.S. PATENT DOCUMENTS

| | | | |
|---|---|---|---|
| 4,406,461 | 9/1983 | McGill | 277/34.6 |
| 4,834,175 | 5/1989 | Ross et al. | 166/120 |
| 4,923,007 | 5/1990 | Sanford et al. | 166/187 |

*Primary Examiner*—William P. Neuder
*Attorney, Agent, or Firm*—Melvin A. Hunn

[57] ABSTRACT

An inflatable packing tool is provided for use in a subterranean wellbore. The inflatable packing tool is coupled to a wellbore conduit with a central bore which directs pressurized fluid into the wellbore. The inflatable packing tool includes a central tubular body for directing fluid in the wellbore. Upper and lower stationary collar members are secured to the central tubular body for coupling the central tubular body to the wellbore conduit. An annular inflatable packing element surrounds the central tubular body, and includes a flexible fluid-tight sleeve covered by a plurality of overlapping an axially extending reinforcing ribs. A slidable sleeve assembly is coupled to one end of the annular inflatable packing element. A locking means is provided for fixing the position of the slidable sleeve assembly during a deflated running mode to prevent axial movement of the slidable sleeve assembly relative to the central tubular body, rotational movement of the slidable sleeve assembly relative to the central tubular body, and twisting of the plurality of overlapping and axially extending reinforcing ribs out of axial alignment with the central longitudinal axis of the central tubular body.

28 Claims, 4 Drawing Sheets

WELLBORE PACKER WITH SHEARABLE ANTI-ROTATION LOCKING MEMBER

BACKGROUND OF THE INVENTION

1. Field of the Invention

The invention relates generally to inflatable packers or bridge plugs for use in subterranean wellbores, and specifically to inflatable packers or bridge plugs which are allowed to move axially in response to inflation forces produced through the introduction of pressurized fluid into an inflation space.

2. Description of the Prior Art

Known prior art inflatable packing devices include annular inflatable covers which usually comprises an inner fluid-tight flexible sleeve covered by a plurality of axially aligned and overlapping reinforcing ribs (or slats).

During a running mode, wellbore packers are placed in position within a wellbore. Frequently, the wellbore packer is exposed to rotational forces which twist the reinforcing ribs out of axial alignment, and which may allow the inner fluid-tight flexible sleeve to extrude through the reinforcing ribs during the inflation process. This presents a danger of injury to the inner fluid-tight flexible sleeve, which can be costly to remedy. This danger is discussed in greater detail below in connection with FIGS. 1 and 2.

SUMMARY OF THE INVENTION

It is one objective of the present invention to provide an inflatable packing device for use in a wellbore which inhibits the twisting of one end of the inflatable packing device relative to the other end, until a predetermined amount of inflation has occurred.

It is another object of the present invention to provide an inflatable packing device for use in a wellbore, which is prevented from twisting prior to inflation by a plurality of shearable locking members disposed at one end of said inflatable packing device.

It is yet another objective of the present invention to provide an inflatable packing device for use in a wellbore which is inhibited from twisting during a deflated running mode, until the packer is axially contracted by inflation during the transition between said deflated running mode and an inflated setting mode and anti-rotation pins are sheared.

These and other objectives are achieved as is now described. An inflatable packing tool is provided for use in a subterranean wellbore. The inflatable packing tool is coupled to a wellbore conduit with a central bore which directs pressurized fluid into the wellbore. The inflatable packing tool includes a central tubular body for directing fluid in the wellbore. Upper and lower stationary collar members are secured to the central tubular body for coupling the central tubular body to the wellbore conduit. An annular inflatable packing element surrounds the central tubular body, and includes a flexible fluid-tight sleeve covered by a plurality of overlapping and axially extending reinforcing ribs. A slidable sleeve assembly is coupled to one end of the annular inflatable packing element. A locking means is provided for fixing the position of the slidable sleeve assembly during a deflated running mode to prevent axial movement of the slidable sleeve assembly relative to the central tubular body, rotational movement of the slidable sleeve assembly relative to the central tubular body, and twisting of the plurality of overlapping and axially extending reinforcing ribs out of axial alignment with the central longitudinal axis of the central tubular body. A valve means is provided for inflating the annular inflatable packing element with pressurized fluid from the wellbore conduit during an inflation mode. Through operation of the valve means, the annular inflatable packing element is prevented from inadvertent inflation during the running mode as the inflatable packing tool is lowered into the wellbore. The plurality of overlapping and axially extending reinforcing ribs are prevented from twisting out of axial alignment in response to rotational forces and hence from damaging the annular inflatable packing element, and especially from damaging the flexible fluid-tight sleeve of the annular inflatable packing element.

The above as well as additional objects, features, and advantages of the invention will become apparent in the following detailed description.

BRIEF DESCRIPTION OF THE DRAWING

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
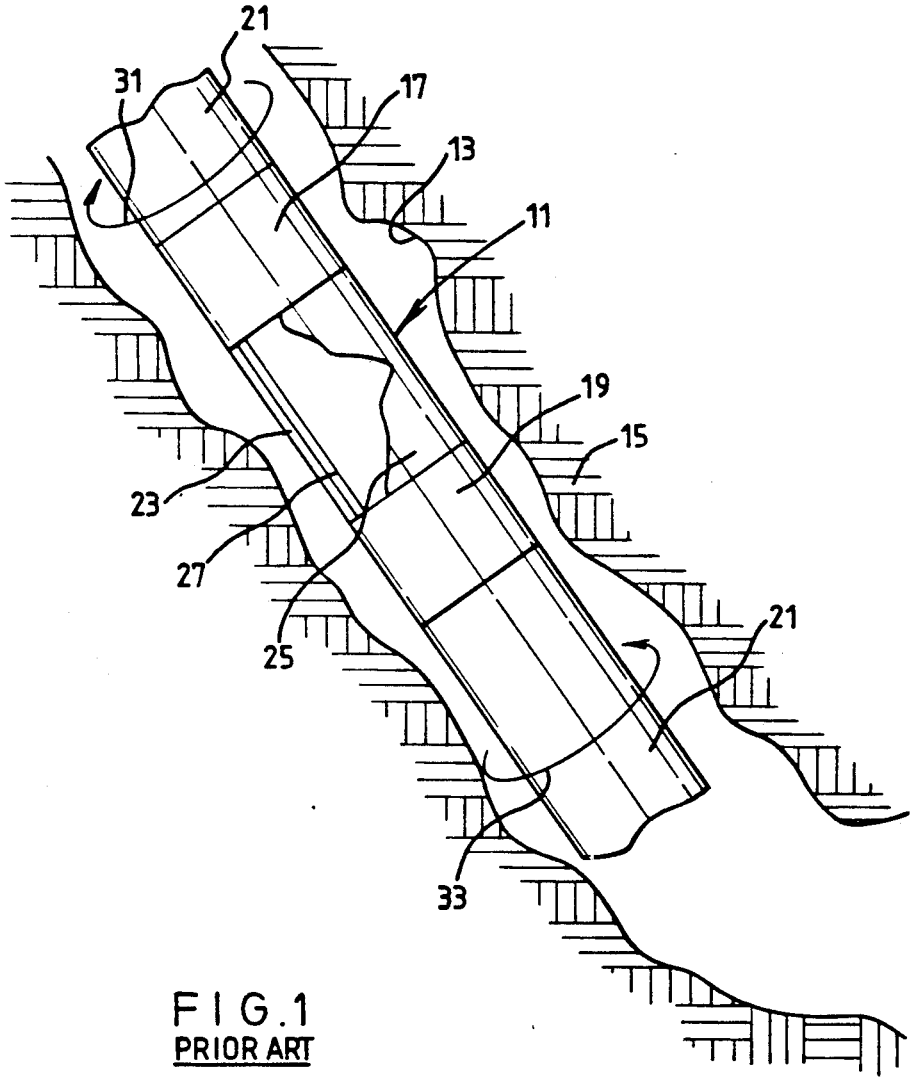
FIG.1 PRIOR ART
FIG. 1 is a simplified partial-cutaway view of a prior art external casing packer (ECP) disposed within a wellbore, which graphically depicts the rotation forces acting upon the ECP.
Figure 2:
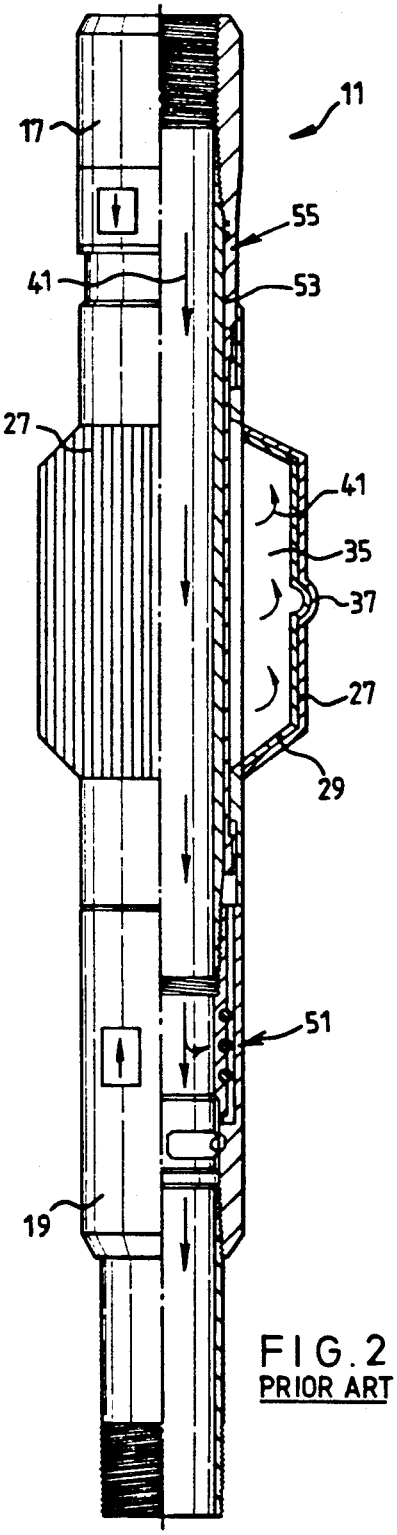
FIG. 2 PRIOR ART
FIG. 2 is a more detailed view of a prior art external casing packer in one-quarter longitudinal section, with the outer elastomeric cover of the ECP removed to illustrate one problem encountered by prior art packers.

FIGS. 1 and 2 illustrate one problem with prior art wellbore packers. With reference now to the figures and in particular with reference to FIG. 1, wellbore packer 11 is shown disposed within wellbore 13, which extends into formation 15. Wellbore packer 11 is an external casing packer (ECP) which is used to set a casing in position within wellbore 13, and is particularly useful in setting casing in deviated and horizontal wellbores.

Wellbore packer 11 is shown in FIG. 1 in simplified form, and includes upper collar 17 and lower collar 19, which couple wellbore packer 11 to casing string 21. Wellbore packer 11 includes a central inflatable region 23 which serves to expand in response to pressurized fluid, and inflates to frictionally engage wellbore 13, and fix the position of wellbore packer 11 and casing string 21 above and below wellbore packer 11 within Wellbore 13.

Wellbore packer 11 is shown in FIG. 1 in fragmentary section with outer elastomeric cover 25 cut away to expose for view the array of overlapping expansion slats 27. Expansion slats 27 overlie inner elastomeric cover 29 (not depicted in FIG. 1). As inner elastomeric cover 29 expands, the array of overlapping expansion slats likewise expand and urge outer elastomeric cover 25 into a frictional engagement of wellbore 13.

Often, a considerable amount of force is required to position casing string 21 in a desired location. This is particularly true in deviated and horizontal wellbores, and is also true if casing string 21 must be passed through a "dogleg" in the wellbore. As a consequence, wellbore packer 11 frequently experiences rotational forces, like the rotational forces depicted in FIG. 1 by force arrows 31, 33. As shown, rotational forces can oppose one another to twist wellbore packer 11.

FIG. 2 graphically depicts the detrimental effect of such twisting on wellbore packer 11. For purposes of exposition, wellbore packer 11 is shown with outer elastomeric cover removed, and in one-quarter longitudinal section, while in an inflated mode. As shown, fluid 41 is diverted from central bore 39 of wellbore packer 11 through valve assembly 51 to inflation region 35 between central tubular body 53 of wellbore packer 11 and inner elastomeric cover 29. Fluid 41 within inflation region 35 acts to expand inner elastomeric cover 29 radially outward, and likewise acts to expand array of overlapping expansion slats 27.

One type of prior art wellbore packer is equipped with a known shearable sliding sleeve assembly, such as the sliding sleeve assembly described in U.S. Pat. No. 4,832,120, entitled "Inflatable Tool For A Subterranean Well," issued on May 23, 1989 to Baker Hughes Incorporated (this U.S. patent is fully incorporated herein by reference). In this prior art device a conventional inflatable packer or bridge plug is described; of course, the concepts of this reference have been used in external casing packers. As stated in this reference, a reinforced sleeve of elastomeric material is mounted in surrounding relationship to a tubular body, with one end of the sleeve fixed and sealably secured to a tubular body and the other end sealably and slidably affixed to the tubular body. The slidable end is shearably secured to the tubular body so that a predetermined amount of axial tension must be produced in the inflatable element to shear the slidable end free.

When rotational forces are applied to one or both ends of such a wellbore packer 11, the array of overlapping expansion slats 27 will not expand in an even fashion, and will in fact be twisted. When the individual slats are twisted out of alignment, it is possible for inner elastomeric sleeve 29 to extrude through gaps between the slats, during the inflation process due to misalignment of the slats or ribs. In FIG. 2, such extrusion is depicted in wellbore packer 11, as extrusion 37. Extrusion of inner elastomeric cover 29 is a very dangerous condition, since expansion slats 27 can pinch, cut, or otherwise damage the inner elastomeric cover 29, and jeopardize its fluid-tight qualities. Once the inner elastomeric cover 29 is punctured or otherwise damaged, wellbore packer 11 becomes useless. This can be an expensive and dangerous problem, especially when wellbore packer 11 is used as an external casing packer to hold a casing in place within a wellbore. The replacement of a external casing packer can be an expensive and time consuming task.

Figure 3:
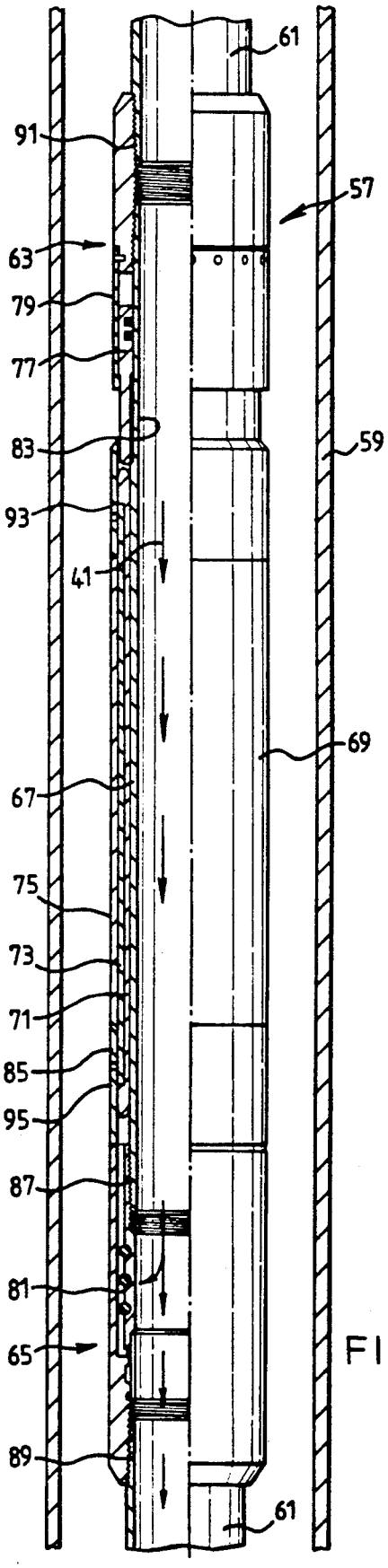
FIG. 3 is a one-quarter longitudinal section view of the external casing packer of the present invention, shown in deflated running mode.
Figure 4:
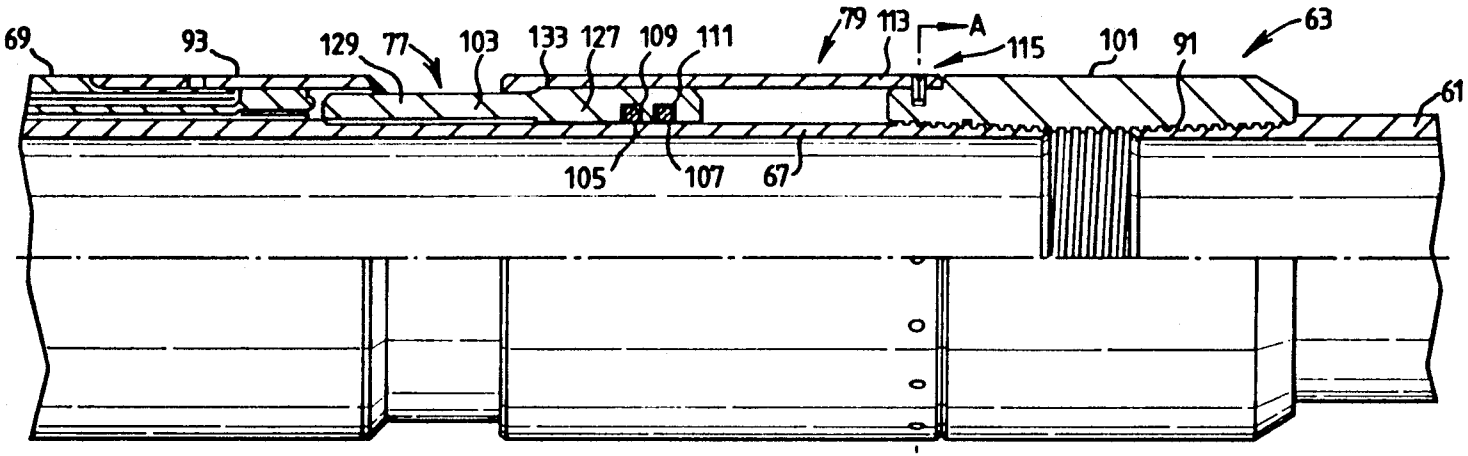
FIG. 4 is a one-quarter longitudinal section view of the upper cylindrical collar assembly of the improved wellbore packer of the present invention.
Figure 7:
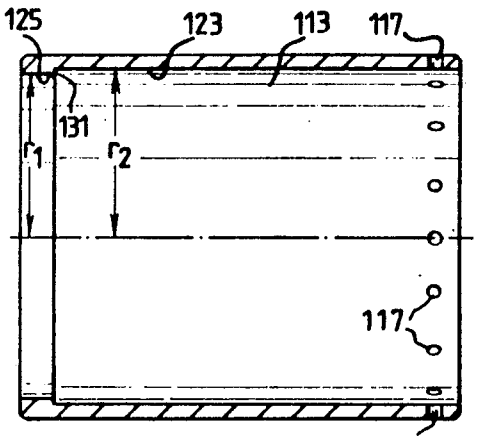
FIG. 7 is a longitudinal view of the cylindrical shear sleeve of FIG. 4.
Figure 8:
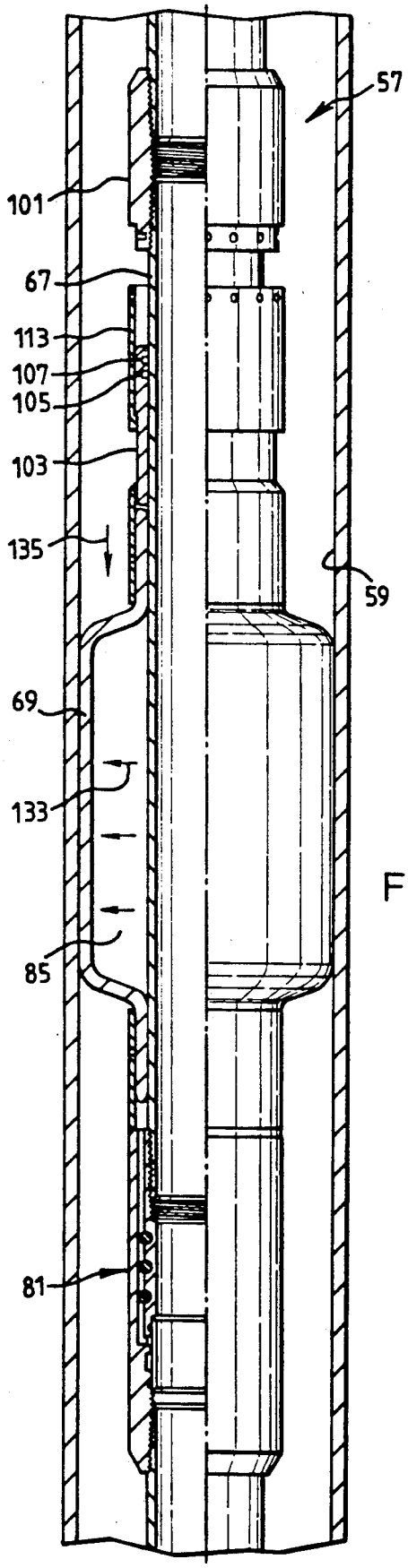
FIG. 8 is a one-quarter longitudinal section view of the external casing packer of the present invention, shown in an inflated setting mode.

The improved wellbore packer with shearable anti-rotation pins of the present invention is depicted in FIGS. 4 through s. FIG. 3 depicts the improved wellbore packer 57 of the present invention in a deflated running mode. FIG. 8 depicts the improved wellbore packer 57 of the present invention in an inflated setting mode. FIGS. 4, 5, 6, and 7 depict in greater detail the anti-rotational locking feature of the present invention. The present invention relates not only to external casing packers but to other types of inflatable packing devices for use in a wellbore, but to simplify the description, a single, preferred embodiment is shown.

Turning now to FIG. 3, improved wellbore packer 57 is shown disposed within wellbore 59, either a cased or uncased wellbore. Improved wellbore packer 57 is shown coupled to casing string 61 at upper and lower collar assemblies 63, 65. Upper collar assembly is connected by threads 91 to casing string 61. Lower collar assembly is coupled by threads 89 to casing string 61. Improved wellbore packer 57 includes a central tubular body 67 which is also coupled to upper and lower collar assemblies by threads 89, 91.

Improved wellbore packer 57 further includes an annular inflatable packing element 69 which surrounds a large portion of said central tubular body 69. Annular inflatable packing element 6 includes inner flexible fluid-tight sleeve 71, an array of overlapping and axially extending reinforcing ribs (or slats) 73, and outer flexible sleeve 75. The particular reinforcing ribs utilized are described generally in U.S. Pat. No. 4,349,204, entitled "Non-Extruding Inflatable Packer Assembly," issued on Sep. 14, 1982 to Lynes, Inc., which is fully incorporated herein by reference. U.S. Pat. Nos. 3,581,816 and 3,604,732 to Malone also describe generally the particular reinforcing ribs, and are also fully incorporated herein by reference.

Slidable sleeve assembly 77 is provided at l the upper end of improved wellbore packer 57. Shearable locking means 79 locks slidable sleeve assembly 75 in place when improved wellbore packer 57 is in a running mode.

Valve means 81 is disposed at the opposite end of improved wellbore packer 57, and serves to direct fluid 41 from the central bore 83 of improved wellbore packer to selectively inflate annular inflatable packing element 69. Valve means 81 is a conventional valving system, such as that described in U.S. Pat. No. 3,437,142, entitled "Inflatable Packer For External Use on Casing and Liners and Method of Use," issued to G. E. Conover on Apr. 8, 1969; this patent is fully incorporated herein by reference.

The valve means 81 receives pressurized fluid 41 from central bore 83 of improved wellbore packer 57. Fluid 41 is pumped downward from the surface through a wellbore conduit, such as casing string 61. Valve means 81 operates during an inflation mode to direct pressurized fluid 41 from central bore 83 to an inflation region 85, which is between inner flexible fluid-tight sleeve 71 and central tubular body 67. Pressurized fluid 41 which is directed into inflation region 85 operates to radially expand annular inflatable packing element 69 causing shearable locking means 79 to shear and become unfixed in position relative to central tubular body 67.

Once shearable locking means is sheared, annular inflatable packing element 69 is allowed to move axially relative to central tubular body 69. Slidable sleeve assembly 77 is also then allowed to move radially (or rotationally) relative to central tubular body 69. Finally, the plurality of overlapping and axially extending reinforcing ribs 73 are allowed to twist in response to rotational forces; however, since the improved wellbore packer 57 is at that time set in a desired position, it is unlikely that the reinforcing ribs 73 will in fact twist or rotate.

Valve means 81 also serves to trap pressurized fluid in inflation region 85 between central tubular body 67 and annular inflatable packing element 69. When fully expanded, improved wellbore packer 57 operates in a setting mode to fix the position of casing string 61 relative to wellbore 59.

Slidable sleeve assembly 77 and shearable locking means 79 cooperate to prevent the inadvertent inflation of improved wellbore packer 57 during a running mode in which improved wellbore packer 57 is lowered into wellbore 59. During the running mode, the plurality of overlapping and axially extending reinforcing ribs 73 are prevented from twisting out of axial alignment in response to rotation forces and damaging inner inflatable packing element 69. In particular, inner flexible fluid-tight sleeve 71 is protected from damage due to twisting of the plurality of overlapping and axially extending reinforcing ribs 73.

Turning now to FIG. 4, upper collar assembly 63 will be discussed in much greater detail. Upper collar assembly 63 includes stationary collar 101 which couples to casing string 61 and central tubular body 67 by internal threads 91. Stationary collar 101 is fixed in position relative to central tubular body 67. Slidable sleeve assembly 77 includes cylindrical seal housing 103 with O-ring seals 105, 107 provided in seal cavities 109, 111. O-ring seals 105, 107 serve to slidably engage, and form a movable seal with, central tubular body 67. Cylindrical seal housing 103 is coupled to annular inflatable packing element 69 at upper cylindrical end cover 93. Slidable sleeve assembly 77 operates to move axially downward relative to central tubular body 67 when annular inflatable packing element 69 is inflated with pressurized fluid 41.

When improved wellbore packer 57 is lowered within wellbore 59, slidable sleeve assembly 77 must be restrained from sliding to prevent annular inflatable packing elements 69 from prematurely inflating in response to localized high fluid pressure. In the present invention, this is accomplished by shearable locking means 79. In the preferred embodiment, shearable locking means includes cylindrical shear sleeve 113 which overlies at least a portion of central tubular body 67 and is fixed in position relative to central tubular body 67 during the deflated running mode by a plurality of radially disposed shearable members which extend through a plurality of openings 117 in cylindrical shear sleeve 113 into a plurality of radially disposed anchor cavities 119 which are fixed in position relative to central tubular body 67.

Figure 5:
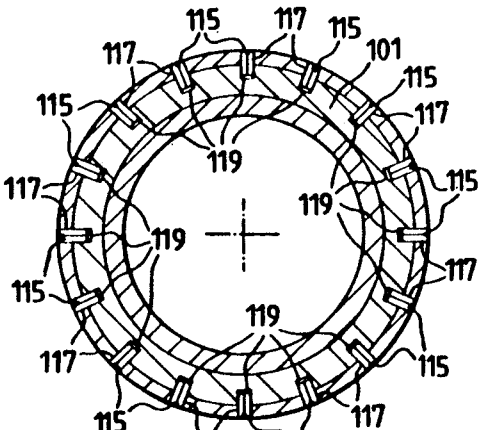
FIG. 5 is a cross-section view of the upper cylindrical collar of FIG. 4 as seen along line A—A.

FIG. 5 is a section view of FIG. 4 as seen along line A—A. This view will aid in understanding the preferred embodiment of the shearable locking means 79. As shown, a plurality of radially disposed shearable members 115 extend through a plurality of openings 117 in cylindrical shear sleeve 113, and descend into a plurality of radially aligned anchor cavities 119 disposed in the outer surface of upper stationary collar 101.

Figure 6:
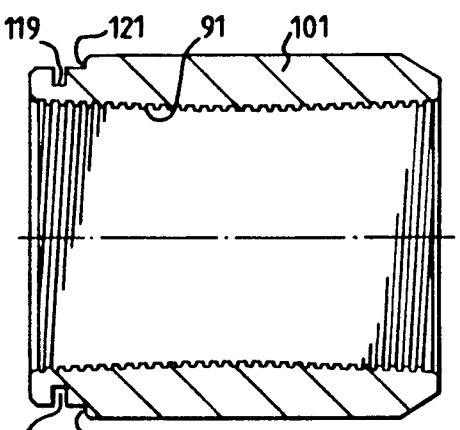
FIG. 6 is a longitudinal section view of the upper stationary collar piece of FIG. 4.

FIG. 6 is a longitudinal section view of upper stationary collar 101. Internal threads 91 serve to couple upper stationary collar 101 to casing string 61 and central tubular body 67. Anchor cavities 119 are provided at the lower end of upper stationary collar 101. A slight lip or notch 121 is provided for mating with cylindrical shear sleeve 113. FIG. 7 is a longitudinal section view of cylindrical shear sleeve 113. Cylindrical shear sleeve 113 includes two regions of differing radial dimensions. Upper region 123 of cylindrical shear sleeve 113 has a radius of r1 and is provided for slidably engaging the slightly enlarged upper region 127 of cylindrical seal housing 103. Lower region 125 Of cylindrical shear sleeve 113 has a smaller radial dimension r2, which is adapted for slidably engaging narrow lower region 129 of cylindrical seal housing 103. The notch 131 formed by the difference in radial diameters r1 and r2 serves to mate with notch 133 at the transition between enlarged upper region 127 and narrow lower region 129 of cylindrical seal housing 103.

FIG. 8 is a view of improved wellbore packer 57 of the present invention in an inflated setting mode. As shown, radial expansion 133 of annular inflatable packing element 69 causes downward movement 135 of cylindrical seal housing 103. O-ring seals 105, 107 maintain a tight seal against central tubular body 67. Eventually, the downward forces acting on cylindrical shear sleeve 113, in response to downward pulling of cylindrical seal housing 103, will cause shearable members 115 to shear.

In the preferred embodiment, shearable members 115 comprise a plurality of threaded shear pins of known shear strength. Therefore, it is possible for one to set a predetermined fluid pressure threshold upon which all of shearable members 115 will shear. Shear strength may be adjusted by known means, such as selecting the total number of pins used, as well as the materials of construction for each shear pin and the radial cross-section of each pin.

When shearable members 115 yield to the downward force, cylindrical shear sleeve 113 will break free of upper stationary collar 101, and allow annular inflatable packing element 69 to expand radially outward. The shear strength of shearable members 115 may be selected to allow for the inflation of improved wellbore packer 57 at a predetermined fluid pressure level, to allow one to selectively change the mode of operation of improved wellbore packer 57 from a deflated running mode to an inflated setting mode.

As stated above, the valve means of the present invention is similar to that claimed and described in U.S. Pat. No. 3,437,142, entitled "Inflatable Packer for External Use on Casing and Liners and Method of Use," issued to G. E. Conover on Apr. 8, 1969. Essentially, valve means 81 prevents the inflation of improved wellbore packer 57 until a predetermined pressure threshold has been passed. Valve means 81 also includes a mechanism by which pressurized fluid 41 may be trapped within inflation region 85 of improved Wellbore packer 57. Valve means 81 will "lock" when a second, higher pressure level is obtained.

Therefore, a relatively low pressure level begins the valving of pressurized fluid into inflation region 85 of improved wellbore packer 57. A second, higher fluid pressure level serves to expand annular inflatable packing element 69 with sufficient force to shear shearable members 115. Upon shearing of shearable members 115, annular inflatable packing element 69 expands further radially outward, and comes into gripping frictional contact with wellbore 59. Improved wellbore packer 57 may be "set" in position by locking valve means 81 by further pressurizing pressurized fluid 41 to a third, still-higher level of pressure. When this occurs, improved wellbore packer 57 of the present invention is permanently set in place within wellbore 59.

The present invention has a significant advantage over the prior art, since harmful twisting of the reinforcing ribs is prevented from occurring when the wellbore packer is in a deflated running mode. Axial and rotational movement is allowed only when rotational movement is least likely to occur, that is, when the wellbore packer has been positioned in a desired location within the wellbore.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

WHAT IS CLAIMED IS:

1. An inflatable packing tool for use in a subterranean wellbore when coupled to a wellbore conduit with a central bore for directing pressurized fluid in said wellbore, comprising, in combination:

a central tubular body for directing fluid in said wellbore, defining a central longitudinal axis;

upper and lower stationary collar members secured to said central tubular body for coupling said central tubular body to said wellbore conduit;

an annular inflatable packing element surrounding said central tubular body, including a flexible fluid-tight sleeve covered by a plurality of overlapping and axially extending reinforcing ribs;

a slidable sleeve assembly coupled to one end of said annular inflatable packing element;

a locking means for fixing the position of said slidable sleeve assembly during a deflated running mode to prevent:

a) axial movement of said slidable sleeve assembly relative to said central tubular body;

b) rotational movement of said slidable sleeve assembly relative to said central tubular body; and c) twisting of said plurality of overlapping and axially extending reinforcing ribs out of axial alignment with said central longitudinal axis of said central tubular body;

a valve means for inflating said annular inflatable packing element with pressurized fluid from said wellbore conduit during an inflation mode; and whereby said annular inflatable packing element is prevented from inadvertent inflation during said running mode as said inflatable packing tool is lowered in said wellbore, and said plurality of overlapping and axially extending reinforcing ribs are prevented from twisting out of axial alignment in response to rotational forces and damaging said annular inflatable packing element, and especially from damaging said flexible fluid-tight sleeve of said annular inflatable packing element.

2. An inflatable packing tool according to claim 1, wherein said annular inflatable packing element further includes an outer flexible sleeve covering at least a portion of said plurality of overlapping and axially extending reinforcing ribs.

3. An inflatable packing tool according to claim 1, wherein said annular inflatable packing element further includes an outer flexible sleeve covering said plurality of overlapping and axially extending reinforcing ribs, and upper and lower cylindrical end covers disposed over the upper and lower ends of said annular inflatable packing element.

4. An inflatable packing tool according to claim 1, wherein said flexible fluid-tight sleeve comprises an elastomeric sleeve.

5. An inflatable packing tool according to claim 1, wherein said plurality of overlapping and axially extending reinforcing ribs comprises a plurality of substantially planar slats of rigid yet deformable material.

6. An inflatable packing tool according to claim 1, wherein said annular inflatable packing element further includes an outer flexible sleeve covering said plurality of overlapping and axially extending reinforcing ribs, and wherein during said inflation mode said flexible fluid-tight sleeve produces a radially outward displacement of said reinforcing ribs to force said outer flexible sleeve into sealing relation with said wellbore.

7. An inflatable packing tool according to claim 1, wherein said slidable sleeve assembly is disposed adjacent said upper stationary collar.

8. An inflatable packing tool according to claim 1, wherein said slidable sleeve assembly includes a cylindrical seal housing and at least one slidable seal for sealingly engaging said central tubular body.

9. An inflatable packing tool according to claim 1, wherein said shearable locking means includes a shear sleeve releasably coupled to one of said stationary collars by at least one shearable member.

10. An inflatable packing tool according to claim 1, wherein said shearable locking means includes a shear sleeve coupled to said slidable sleeve assembly and is releasably coupled to one of said stationary collars by at least one shearable member.

11. An inflatable packing tool according to claim 1, wherein said slidable sleeve assembly includes:

a cylindrical seal housing with at least one slidable seal for sealingly engaging said central tubular body, and wherein said shearable locking means includes a shear sleeve coupled to said cylindrical seal housing, said shear sleeve being releasably coupled to one of said stationary collars by at least one shearable member.

12. An inflatable packing tool according to claim 1, wherein said shearable locking means includes:

a cylindrical shear sleeve overlying at least a portion of said central tubular body, fixed in position relative to said central tubular body during a deflated running mode by a plurality of radially disposed shearable member which extend through a plurality of openings in said cylindrical shear sleeve into a plurality of radially disposed anchor cavities which are fixed in position relative to said central tubular body, wherein during an inflation mode said plurality of shearable members are sheared by axial movement of said cylindrical shear sleeve relative to said central tubular body in response to outward radial expansion of said annular inflatable packing element.

13. An inflatable packing tool according to claim 1, wherein:

said slidable sleeve assembly includes a cylindrical seal housing and at least one slidable seal for sealingly engaging said central tubular body;

said stationary collar member proximate said slidable sleeve assembly includes a plurality of radially disposed anchor cavities;

said shearable locking means includes a cylindrical shear sleeve with a plurality of radially disposed anchor ports disposed therein, overlying at least a portion of said cylindrical seal housing and at least a portion of said stationary collar, with said radially disposed anchor ports in alignment with said radially disposed anchor cavities; and said shearable locking means further including a plurality of shear bolts extending through said plurality of anchor ports of said cylindrical shear sleeve into said plurality of radially disposed anchor cavities of said stationary collar member.

14. An inflatable packing tool according to claim 1, wherein said valve means:

a) prevents pressurized fluid from entering said inflation region until a predetermined inflation pressure is obtained by said pressurized fluid;

b) allows pressurized fluid to enter said inflation region until a predetermined locking pressure is obtained by said pressurized fluid; and thereafter c) prevents pressurized fluid from evacuating from said inflation region irrespective of the pressure level of said pressurized fluid.

15. An inflatable packing tool for use in a subterranean wellbore when coupled to a wellbore conduit with a central bore for directing pressurized fluid in said wellbore, comprising, in combination:

a central tubular body for directing fluid in said wellbore, defining a central longitudinal axis;

upper and lower stationary collar members secured to said central tubular body for coupling said central tubular body to said wellbore conduit;

an annular inflatable packing element surrounding said central tubular body, including a flexible fluid-tight sleeve covered by a plurality of overlapping and axially extending reinforcing ribs;

a slidable sleeve assembly coupled to one end of said annular inflatable packing element;

a shearable locking means for fixing the position of said slidable sleeve assembly during a deflated running mode to prevent:

a) axial movement of said slidable sleeve assembly relative to said central tubular body;

b) rotational movement of said slidable sleeve assembly relative to said central tubular body; and c) twisting of said plurality of overlapping and axially extending reinforcing ribs out of axial alignment with said central longitudinal axis of said central tubular body;

a valve means for receiving pressurized fluid from said wellbore conduit during an inflation mode to:

a) direct pressurized fluid from said wellbore conduit to an inflation region between said central tubular body and said annular inflatable packing element;

b) cause said shearable locking means to shear and become unfixed in position relative to said central tubular body, allowing:

i) axial movement of said slidable sleeve assembly relative to said central tubular body;

ii) rotational movement of said slidable sleeve assembly relative to said central tubular body; and iii) twisting of said plurality of overlapping and axially extending reinforcing ribs out of axial alignment with said central longitudinal axis of said central tubular member;

c) trap pressurized fluid in said inflation region between said central tubular body and said annular inflatable packing element to maintain said annular inflatable packing element in an inflated setting mode fixed in position relative to said wellbore;

whereby said annular inflatable packing element is prevented from inadvertent inflation during said running mode as said inflatable packing tool is lowered in said wellbore, and said plurality of overlapping and axially extending reinforcing ribs are prevented from twisting out of axial alignment in response to rotational forces and damaging said annular inflatable packing element, and especially from damaging said flexible fluid-tight sleeve of said annular inflatable packing element.

16. An inflatable packing tool according to claim 15, wherein said annular inflatable packing element further includes an outer flexible sleeve covering at least a portion of said plurality of overlapping and axially extending reinforcing ribs.

17. An inflatable packing tool according to claim 15, wherein said annular inflatable packing element further includes an outer flexible sleeve covering said plurality of overlapping and axially extending reinforcing ribs, and upper and lower cylindrical end covers disposed over the upper and lower ends of said annular inflatable packing element.

18. An inflatable packing tool according to claim 15, wherein said flexible fluid-tight sleeve comprises an elastomeric sleeve.

19. An inflatable packing tool according to claim 15, wherein said plurality of overlapping and axially extending reinforcing ribs comprises a plurality of substantially planar slats of rigid yet deformable material.

20. An inflatable packing tool according to claim 15, wherein said annular inflatable packing element further includes an outer flexible sleeve covering said plurality of overlapping and axially extending reinforcing ribs, and wherein during said inflation mode said flexible fluid-tight sleeve produces a radially outward displacement of said reinforcing ribs to force said outer flexible sleeve into sealing relation with said wellbore.

21. An inflatable packing tool according to claim 15, wherein said slidable sleeve assembly is disposed adjacent said upper stationary collar.

22. An inflatable packing tool according to claim 15, wherein said slidable sleeve assembly includes a cylindrical seal housing and at least one slidable seal for sealingly engaging said central tubular body.

23. An inflatable packing tool according to claim 15, wherein said shearable locking means includes a shear sleeve releasably coupled to one of said stationary collars by at least one shearable member.

24. An inflatable packing tool according to claim 15, wherein said shearable locking means includes a shear sleeve coupled to said slidable sleeve assembly and is releasably coupled to one of said stationary collars by at least one shearable member.

25. An inflatable packing tool according to claim 15, wherein said slidable sleeve assembly includes:

a cylindrical seal housing with at least one slidable seal for sealingly engaging said central tubular body, and wherein said shearable locking means includes a shear sleeve coupled to said cylindrical seal housing, said shear sleeve being releasably coupled to one of said stationary collars by at least one shearable member.

26. An inflatable packing tool according to claim 15, wherein said shearable locking means includes:

a cylindrical shear sleeve overlying at least a portion of said central tubular body, fixed in position relative to said central tubular body during a deflated running mode by a plurality of radially disposed shearable members which extend through a plurality of openings in said cylindrical shear sleeve into a plurality of radially disposed anchor cavities which are fixed in position relative to said central tubular body, wherein during an inflation mode said plurality of shearable members are sheared by axial movement of said cylindrical shear sleeve relative to said central tubular body in response to outward radial expansion of said annular inflatable packing element.

27. An inflatable packing tool according to claim 15, wherein:

said slidable sleeve assembly includes a cylindrical seal housing and at least one slidable seal for sealingly engaging said central tubular body;

said stationary collar member proximate said slidable sleeve assembly includes a plurality of radially disposed anchor cavities;

said shearable locking means includes a cylindrical shear sleeve with a plurality of radially disposed anchor ports disposed therein, overlying at least a portion of said cylindrical seal housing and at least a portion of said stationary collar, with said radially disposed anchor ports in alignment with said radially disposed anchor cavities; and said shearable locking means further including a plurality of shear bolts extending through said plurality of anchor ports of said cylindrical shear sleeve into said plurality of radially disposed anchor cavities of said stationary collar member.

28. An inflatable packing tool according to claim 15, wherein said valve means:

a) prevents pressurized fluid from entering said inflation region until a predetermined inflation pressure is obtained by said pressurized fluid;

b) allows pressurized fluid to enter said inflation region until a predetermined locking pressure is obtained by said pressurized fluid; and thereafter c) prevents pressurized fluid from evacuating from said inflation region irrespective of the pressure level of said pressurized fluid.

* * * * *